US006305046B1

(12) United States Patent
Kingry et al.

(10) Patent No.: US 6,305,046 B1
(45) **Date of Patent: *Oct. 23, 2001**

(54) CLEANING IMPLEMENTS HAVING STRUCTURES FOR RETAINING A SHEET

(75) Inventors: Gary William Kingry, Cincinnati; Wilbur Cecil Strickland, Loveland; Michael Earl Hardy, Cincinnati, all of OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/374,714

(22) Filed: Aug. 13, 1999

Related U.S. Application Data

(63) Continuation-in-part of application No. 29/094,261, filed on Sep. 29, 1998, now Pat. No. Des. 423,742, which is a continuation-in-part of application No. 29/088,832, filed on Jun. 2, 1998, now Pat. No. Des. 409,343.

(51) Int. Cl.[7] ..... A47L 13/254
(52) U.S. Cl. ..... 15/231; 15/228
(58) Field of Search ..... 15/144.2, 228, 15/231, 232; D32/40, 50

(56) References Cited

U.S. PATENT DOCUMENTS

| | | |
|---|---|---|
| D. 358,238 | 5/1995 | Barnett . |
| D. 364,715 | 11/1995 | Amram et al. . |
| D. 386,851 | 11/1997 | Levine . |
| D. 391,715 | 3/1998 | Irwin et al. . |
| D. 409,343 | 5/1999 | Kingry et al. . |
| 1,998,634 | 4/1935 | Oberti . |
| 2,127,886 | 8/1938 | Plon . |
| 2,138,288 | 11/1938 | Bailey . |
| 2,205,535 | 6/1940 | Muckenhirn . |
| 2,262,334 | 11/1941 | Rugaard . |
| 2,301,586 | 11/1942 | Rubin . |
| 2,584,640 | 2/1952 | Taylor . |
| 2,655,413 | 10/1953 | Russell . |
| 2,690,582 | 10/1954 | Sundell . |
| 2,875,460 | 3/1959 | Legge . |

(List continued on next page.)

FOREIGN PATENT DOCUMENTS

| | | |
|---|---|---|
| 819963 | 8/1969 | (CA) . |
| 1103864 | 6/1981 | (CA) . |
| 1149561 | 7/1983 | (CA) . |
| 2003612 | 5/1990 | (CA) . |
| 2003613 | 5/1990 | (CA) . |
| 1315502 | 4/1993 | (CA) . |
| 76973 | 8/1995 | (CA) . |
| 798408 | 11/1935 | (FR) . |
| 2 285 213 A | 7/1995 | (GB) . |
| 5-13349 | 2/1993 | (JP) . |
| 21421 | 6/1994 | (JP) . |

(List continued on next page.)

*Primary Examiner*—Terrence R. Till
(74) *Attorney, Agent, or Firm*—James C. Vago; Jeffrey V. Bamber; Thibault Fayette

(57) ABSTRACT

A cleaning implement, such as a floor mop, is provided. The cleaning implement includes a handle and a cleaning head attached to the handle. The cleaning head has at least one attachment structure for receiving and retaining a sheet about the cleaning head. The attachment structure includes a base triangle and a plurality of substantially pie-shaped sections whose apexes meet at a substantially common point adjacent the base triangle. Two sides of the base triangle and two sides of each of the pie-shaped sections are defined by slits passing through the flexible material forming the attachment structure such that the base triangle and each of the pie-shaped sections can be deflected to receive the sheet.

10 Claims, 6 Drawing Sheets

U.S. PATENT DOCUMENTS

| | | | | |
|---|---|---|---|---|
| 2,932,048 | | 4/1960 | Yamen et al. . | |
| 3,099,855 | * | 8/1963 | Nash | 15/231 |
| 3,199,136 | | 8/1965 | George . | |
| 3,295,155 | | 1/1967 | Belsky et al. . | |
| 3,358,313 | | 12/1967 | Grimes, Sr. . | |
| 3,760,450 | | 9/1973 | Griffin et al. . | |
| 3,768,110 | | 10/1973 | Johnson et al. . | |
| 3,778,860 | | 12/1973 | Thielen . | |
| 3,792,505 | | 2/1974 | Saltzstein . | |
| 3,806,982 | | 4/1974 | Park . | |
| 3,877,103 | * | 4/1975 | Nash | 15/231 |
| 3,991,431 | | 11/1976 | Thielen . | |
| 3,996,639 | | 12/1976 | Griffin et al. . | |
| 4,069,537 | | 1/1978 | Matsuo . | |
| 4,165,550 | | 8/1979 | Burke . | |
| 4,182,577 | | 1/1980 | O'Dwyer et al. . | |
| 4,312,598 | | 1/1982 | Vagner . | |
| 4,455,705 | | 6/1984 | Graham . | |
| 4,685,167 | | 8/1987 | Murray . | |
| 4,766,632 | | 8/1988 | Murray . | |
| 4,829,719 | | 5/1989 | Braselton . | |
| 4,852,210 | | 8/1989 | Krajicek . | |
| 4,971,471 | | 11/1990 | Sloan . | |
| 4,991,250 | | 2/1991 | Young . | |
| 5,071,489 | | 12/1991 | Silvenis et al. . | |
| 5,080,517 | | 1/1992 | Lynn . | |
| 5,090,832 | | 2/1992 | Rivera et al. . | |
| 5,094,559 | | 3/1992 | Rivera et al. . | |
| 5,379,478 | | 1/1995 | Vosbikian . | |
| 5,390,390 | | 2/1995 | Kresse et al. . | |
| 5,419,015 | | 5/1995 | Garcia . | |
| 5,426,809 | | 6/1995 | Muta . | |
| 5,455,980 | | 10/1995 | Buchanan . | |
| 5,477,582 | | 12/1995 | Yamashita . | |
| 5,815,878 | | 10/1998 | Murakami et al. . | |
| 5,876,141 | | 3/1999 | Hsu . | |
| 5,953,784 | * | 9/1999 | Suzuki et al. | 15/209.1 |
| 6,098,239 | * | 8/2000 | Vosbikian | 15/231 |

FOREIGN PATENT DOCUMENTS

| | | |
|---|---|---|
| 7-255659 | 10/1995 | (JP) . |
| 7-255660 | 10/1995 | (JP) . |
| 07-327904 | 12/1995 | (JP) . |
| 07-327905 | 12/1995 | (JP) . |
| 327906 | 12/1995 | (JP) . |
| 3022675 | 1/1996 | (JP) . |
| 8-522 | 1/1996 | (JP) . |
| 8-56883 | 3/1996 | (JP) . |
| 131387 | 5/1996 | (JP) . |
| 131388 | 5/1996 | (JP) . |
| 2507300 | 5/1996 | (JP) . |
| 8-117168 | 5/1996 | (JP) . |
| 8-154881 | 6/1996 | (JP) . |
| 8-154883 | 6/1996 | (JP) . |
| 8-154884 | 6/1996 | (JP) . |
| 187210 | 7/1996 | (JP) . |
| 8-196498 | 8/1996 | (JP) . |
| 8-215124 | 8/1996 | (JP) . |
| 8-228985 | 9/1996 | (JP) . |
| 8-243067 | 9/1996 | (JP) . |
| 8-266456 | 10/1996 | (JP) . |
| 6708504 | 6/1967 | (NL) . |

* cited by examiner

CLEANING IMPLEMENTS HAVING STRUCTURES FOR RETAINING A SHEET

This application is a continuation-in part of application Ser. No. 29/094,261 filed Sep. 29, 1998 now U.S. Pat. No. D423,742 which is a continuation-in-part of application Ser. No. 29/088,832, filed Jun. 2, 1998, now U.S. Pat. No. D409,343.

TECHNICAL FIELD OF THE INVENTION

The present invention relates to the field of cleaning implements, and, more particularly, to the field of floor mops having structures for retaining a sheet thereabout.

BACKGROUND OF THE INVENTION

Mops which utilize a sheet, such as a woven or non-woven sheet, for cleaning are known in the art. Various structures have been used to secure the sheet to a mop head. For example, U.S. Pat. No. 5,815,878 to Murakami et al. discloses a sweeping device having a sweeper head with a pair of clamping members while JP3022675 appears to disclose a mop having a plurality of serrated structures located on the mop head for receiving a sheet. While these structures may have been suitable for the purposes for which they were intended, there exists a need to provide improved cleaning implements, especially floor mops, having simplified structures for receiving and retaining a sheet about the cleaning head of the cleaning implement. Still further, there exists a need to provide improved cleaning implements which more effectively retain the sheet about the cleaning head during use.

SUMMARY OF THE INVENTION

A cleaning implement, such as a floor mop, is provided. The cleaning implement includes a handle and a cleaning head attached to the handle. The cleaning head has at least one attachment structure for receiving and retaining a sheet about the cleaning head. The attachment structure includes a base triangle and a plurality of substantially pie-shaped sections whose apexes meet at a substantially common point adjacent the base triangle. Two sides of the base triangle and two sides of each of the pie-shaped sections are defined by slits passing through the flexible material forming the attachment structure such that the base triangle and each of the pie-shaped sections can be deflected to receive the sheet.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE PREFERRED EMBODIMENTS

Figure 1:
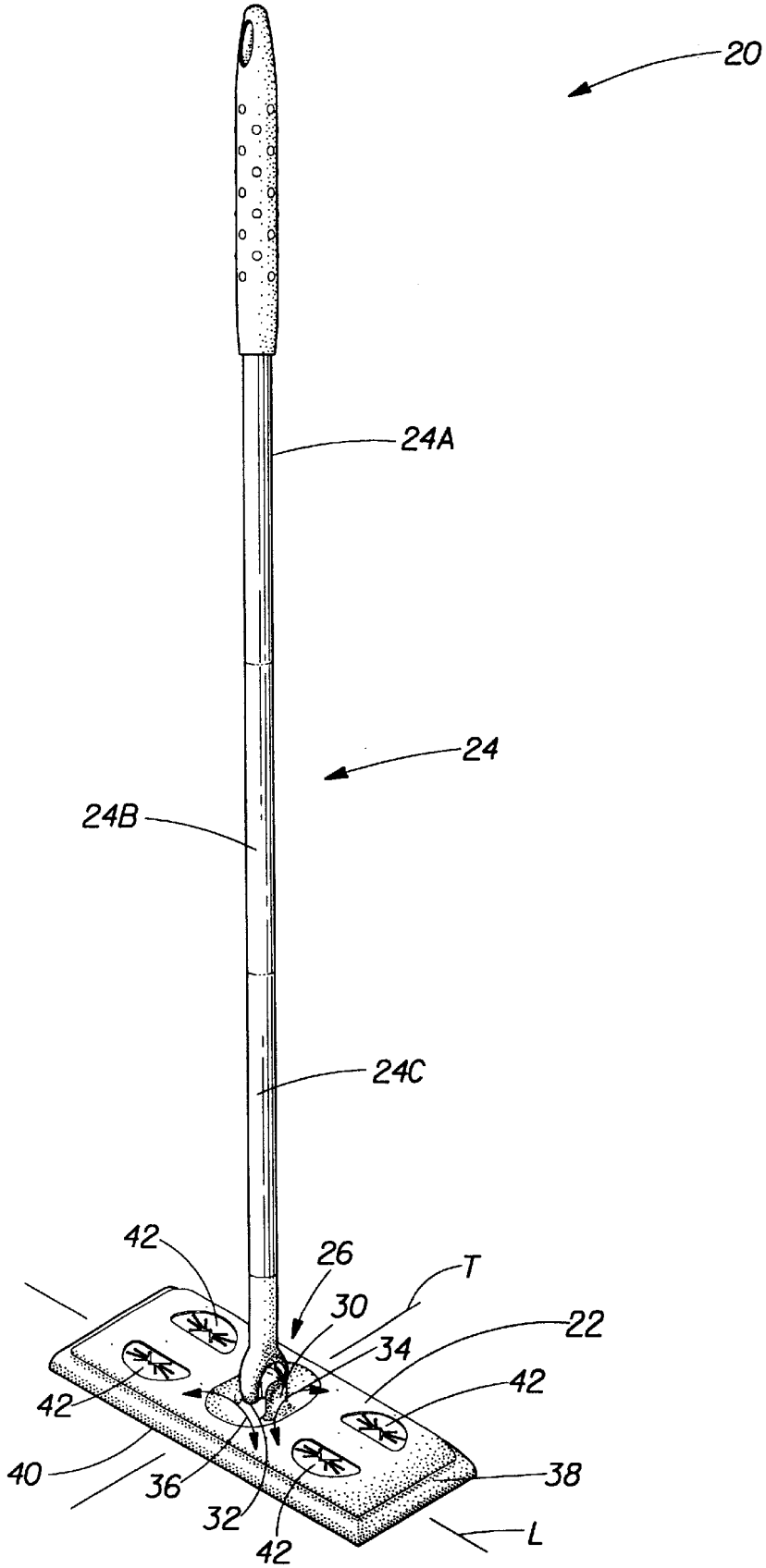
FIG. 1 is a perspective view of a preferred floor mop made in accordance with the present invention.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements. As discussed more fully hereafter, the present invention is, in its most preferred form, directed to a mop having a mop head with attachment structures for securing a sheet about the mop head. While the present invention is discussed herein with respect to a floor mop for purposes of simplicity and clarity, it will be understood that the present invention can be used with other types of cleaning implements having other types of cleaning heads with attachment structures for securing a sheet about the cleaning head. For instance, the present invention can be used with other floor mops, wall and other smaller hand-held dusters, wet mops which utilize a cleaning solution, and other cleaning implements.

Figure 2:
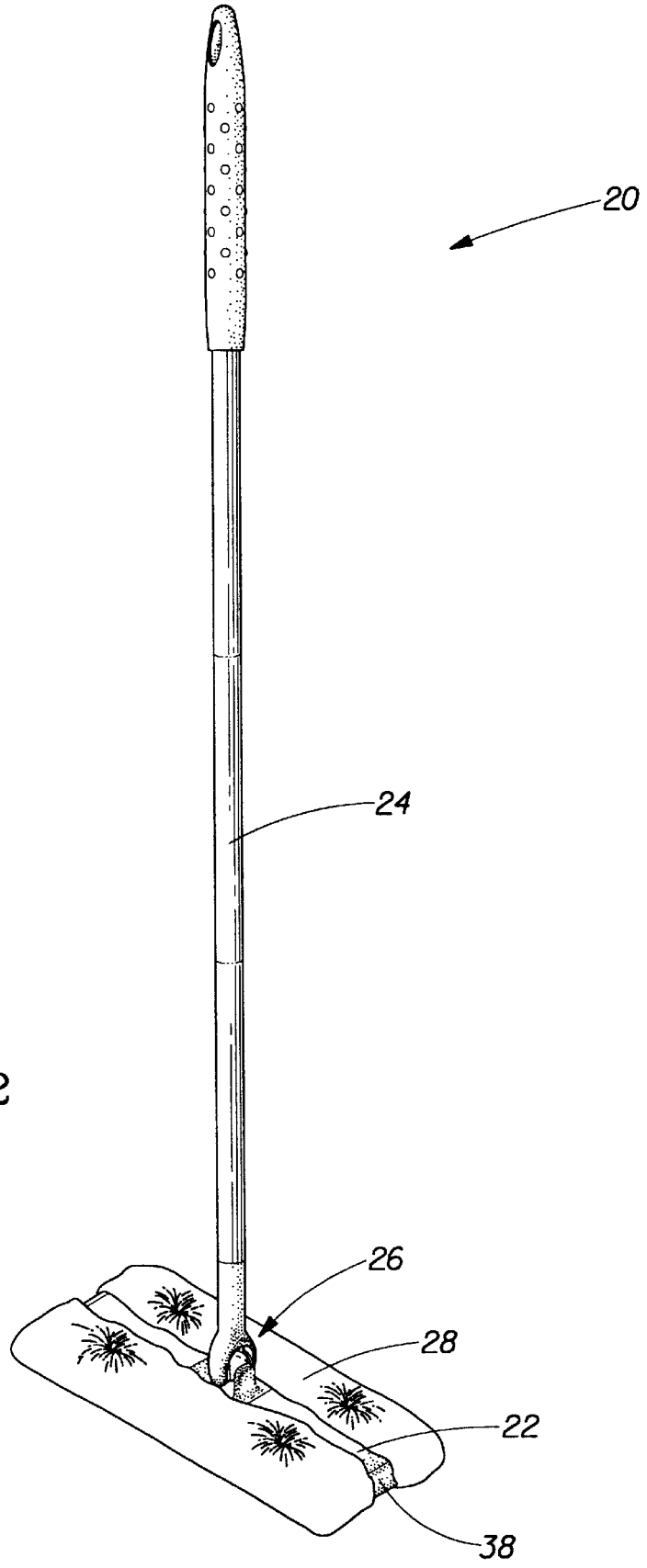
FIG. 2 is a perspective view of the floor mop of FIG. 1, wherein a sheet is attached to the mop head.

Referring to FIGS. 1 and 2, a particularly preferred floor mop 20 made in accordance with the present invention is illustrated. The floor mop 20 comprises a mop head 22 and a handle 24 pivotally connected to the mop head 22 by a universal joint 26. The floor mop 20 is preferably used in combination with a sheet 28 (FIG. 2) which can be provided in the form of a woven or non-woven fabric. As used herein, the phrase "mop head" is intended to refer to the structure which supports and retains the sheet 28. As will be appreciated, the mop head 22 illustrated in the accompanying figures is but one configuration which is suitable for use with the present invention. The mop head 22 can be provided in other shapes and sizes and may be configured for other types of cleaning, such cleaning walls, around corners, furniture and the like.

Figure 3A:
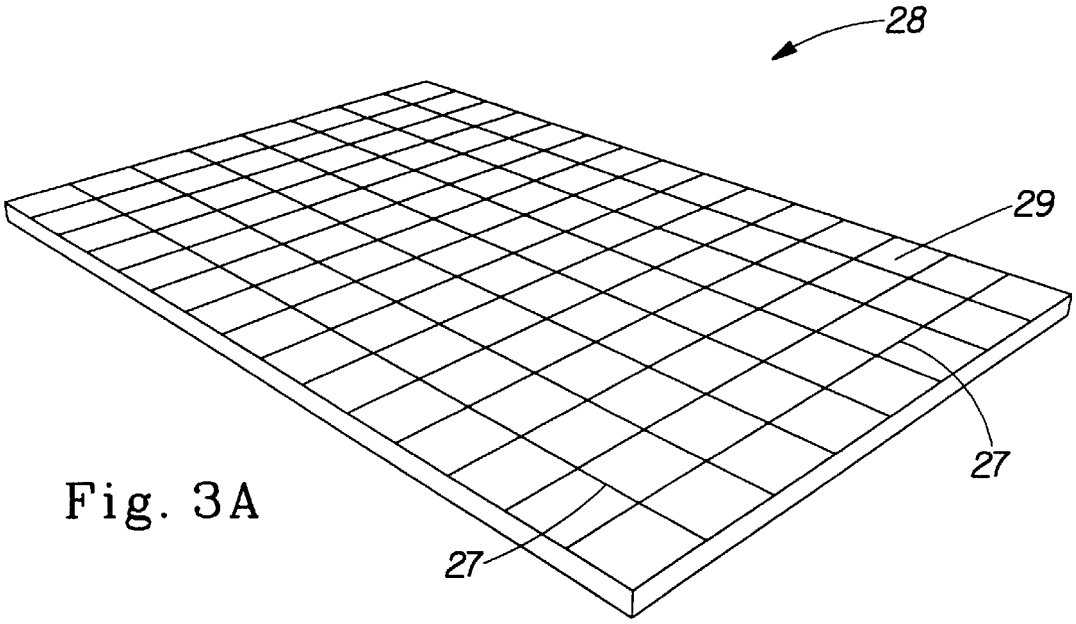
FIG. 3*a* is a schematic perspective view of a preferred sheet suitable for use with the floor mop of FIG. 1.

Preferred sheets which are suitable for use with the present invention are more fully described in U.S. patent application Ser. Nos. 09/082,349 entitled "Novel Structures Useful As Cleaning Sheets", filed May 20, 1998; and 09/082,396 entitled "Novel Three Dimensional Structures Useful As Cleaning Sheets", filed May 20, 1998, both of which are hereby incorporated herein by reference. The sheets described in these applications preferably comprise two components: a polymeric net or scrim 27 and a fibrous material 29 which is laid upon the scrim 29, as shown schematically in FIG. 3*a*, by lamination via heat or chemical means such as adhesives or by hydrogentanglement. Scrim materials useful herein are described in detail in U.S. Pat. No. 4,636,419, which is incorporated by reference herein. The scrims may be formed directly at the extrusion die or can be derived from extruded films by fibrillation or by embossment, followed by stretching and splitting. The scrim may be derived from a polyolefin such as polyethylene or polypropylene, copolymers thereof, poly(butylene terephthalate), polyethylene terephthalate, NYLON 6, NYLON 66, and the like. Scrim materials are available from various commercial sources. A preferred scrim material useful in the present invention is a polypropylene scrim, available from Conwed Plastics of Minneapolis, Minn.

Figure 3B:
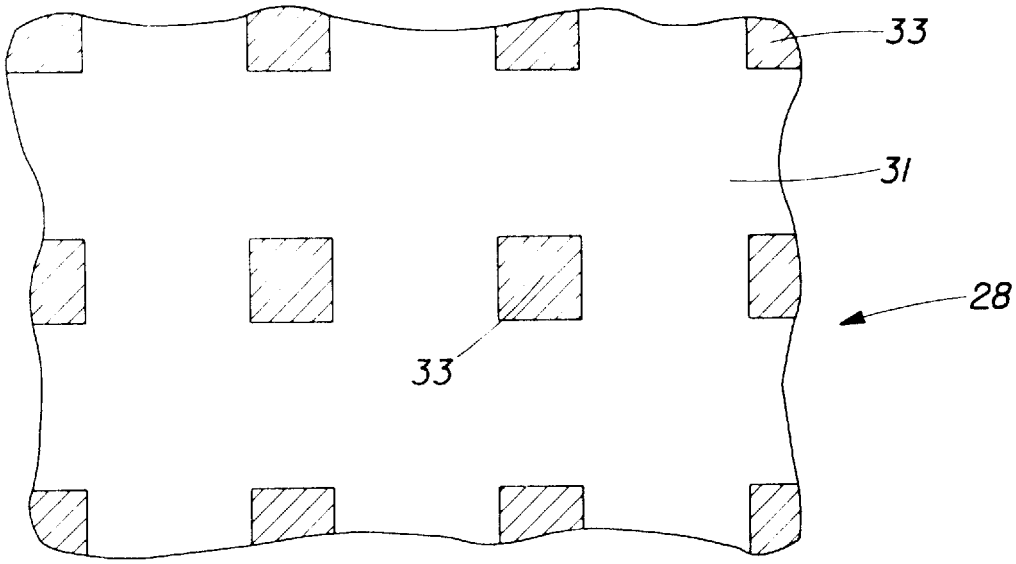
FIG. 3*b* is schematic plan view of the preferred sheet of FIG. 3*a* illustrating the basis weight differences of the sheet.
Figure 3C:
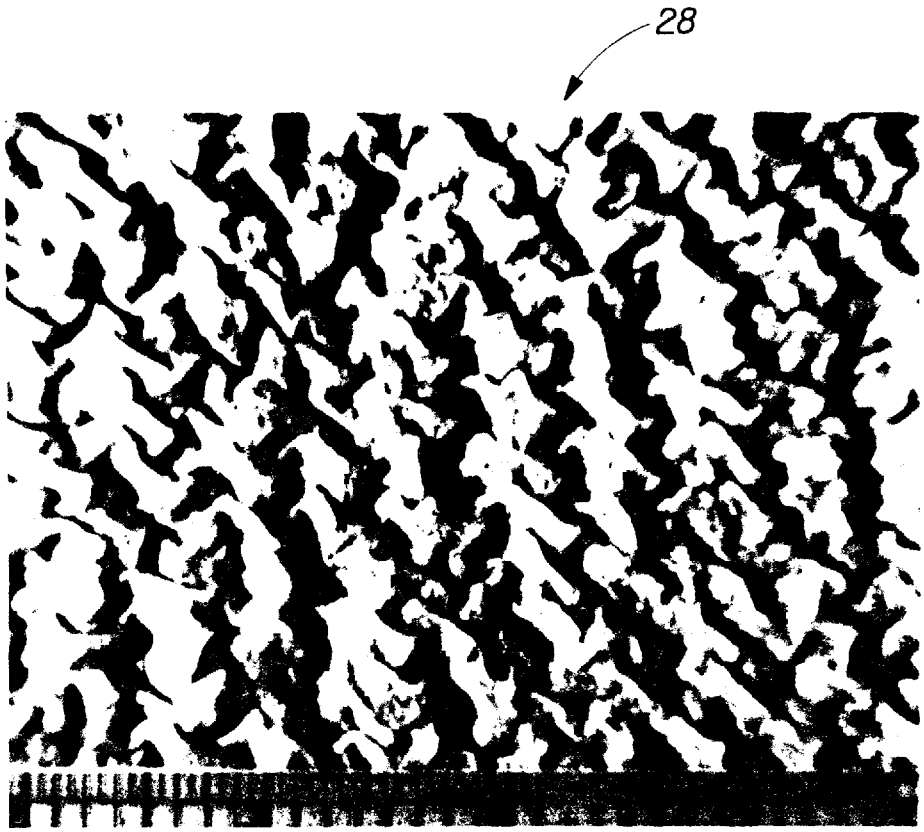
FIG. 3*c* is a photomicrograph of the preferred sheet of FIG. 3*a* showing a textured three-dimensional surface.

The sheets also preferably have a continuous high and discrete low basis weight regions 31 and 33, respectively, such as shown schematically in FIG. 3*b*, and/or a three-dimensional surface, such as shown in FIG. 3*c*, both features being more fully described in U.S. patent application Ser. Nos. 09/082,349 and 09/082,396. While the low basis weight regions are depicted as being of essentially the same size and of a single well defined shape, these regions may be of differing sizes to facilitate entrapment of particles of varying size and shape. The high and low basis weight regions and the three dimensionality of the surface of the sheet shown in FIGS. 3*b* and 3*c* assist in receiving and trapping material, such as dust and dirt, in the sheet.

The sheets can be made using either a woven or non-woven process, or by forming operations using melted materials laid down on forms, especially in belts, and/or by forming operations involving mechanical actions/modifications carried out on films. The structures are made by any number of methods (e.g., spunbonded, meltblown, resin bonded, air-through bonded, etc.), once the essential three dimensional and basis weight requirements are known. However, the preferred structures are nonwoven, and especially those formed by hydroentanglement as is well known in the art, since they provide highly desirable open structures. Also preferred are heat-bonded nonwoven structures which utilize continuous filaments bonded to a base sheet via heat-sealed lines.

Materials particularly suitable for forming the fibrous material 29 of sheet 28 include, for example, natural cellulosics as well as synthetics such as polyolefins (e.g., polyethylene and polypropylene), polyesters, polyamides, synthetic cellulosics (e.g., RAYONS®), and blends thereof. Also useful are natural fibers, such as cotton or blends thereof and those derived from various cellulosic sources. Preferred starting materials for making the hydroentangled fibrous sheets of the present invention are synthetic materials, which may be in the form of carded, spunbonded, meltblown, airlaid, or other structures. Particularly preferred are polyesters, especially carded polyester fibers. The degree of hydrophobicity or hydrophilicity of the fibers is optimized depending upon the desired goal of the sheet, either in terms of type of soil to be removed, the type of additive that is provided, when an additive is present, biodegradability, availability, and combinations of such considerations. In general, the more biodegradable materials are hydrophilic, but the more effective materials tend to be hydrophobic.

Referring to FIG. 1, the universal joint 26 includes a first rotational joint 30 having a shaft with an axis parallel to the longitudinal axis L of the mop head 22 and a second coplanar rotational joint 32 having a shaft with an axis perpendicular to the longitudinal axis L of the mop head 22 so that the handle 24 can rotate in the directions 34 and 36 as shown. The mop head 22 also comprises an elastic member 38 which is disposed about the periphery of the mop head 22. The elastic member 38 has a substantially flat bottom surface 40. During use, the elastic member 38 supports and tensions the sheet 28 about the mop head 22. The handle 24 comprises three sections 24*a*, 24*b* and 24*c* which are threadedly interconnected with each other so that the floor mop 20 can be shipped within a carton of convenient size and later assembled for use. The section 24*a* can be provided with an elastic and resilient section suitable for gripping by a user of the floor mop 20. The mop head 22 and universal joint 26 are preferably formed from ABS type-polymers (e.g., terpolymer from acrylonitrile), polypropylene or other plastic material by injection molding. The elastic member 38 is preferably formed from polyurethane by molding. The mop handle 24 can be formed from aluminum, plastic, or other structural materials.

While the above-described floor mop is preferred, it will be understood that other arrangements, materials and configurations would be equally suitable for use with the present invention. For example, other joints can be used in place of the universal joint 26 to provide relative movement between the handle 24 and the mop head 22 as is known in the art. Still further, the handle 24 can be provided as a unitary structure while the mop head 22 can be provided in the form of other shapes and configurations (e.g., with a textured bottom surface, curvilinear side walls, etc.).

Figure 4:
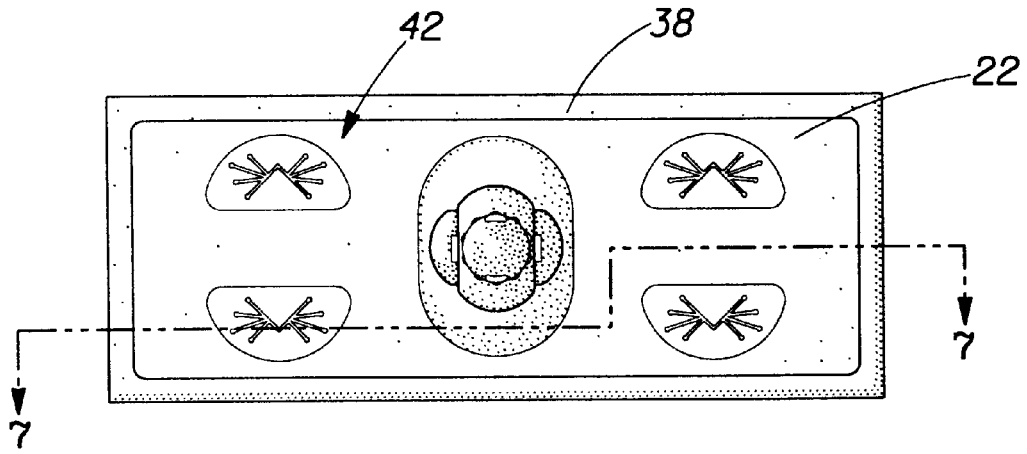
FIG. 4 is top view of the mop head of FIG. 1.
Figure 5:
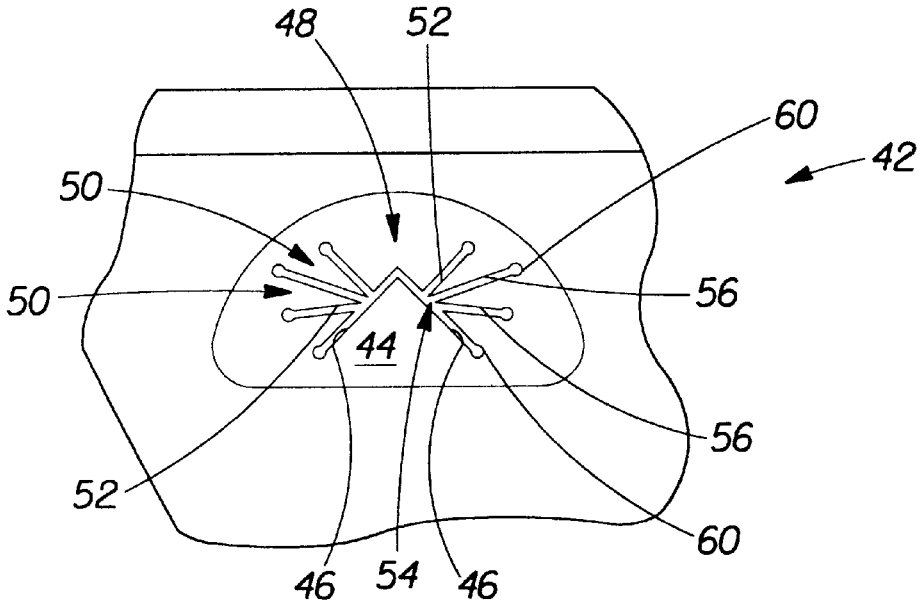
FIG. 5 is an enlarged partial top view of the mop head of FIG. 4.
Figure 6:
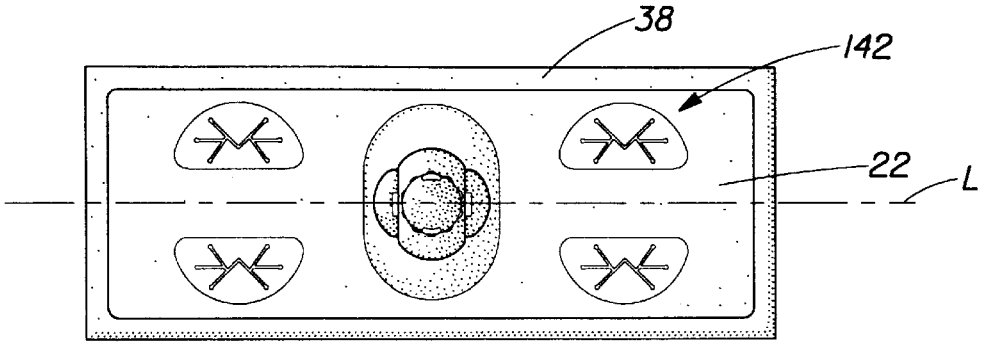
FIG. 6 is a top view of another preferred mop head made in accordance with the present invention.
Figure 7:
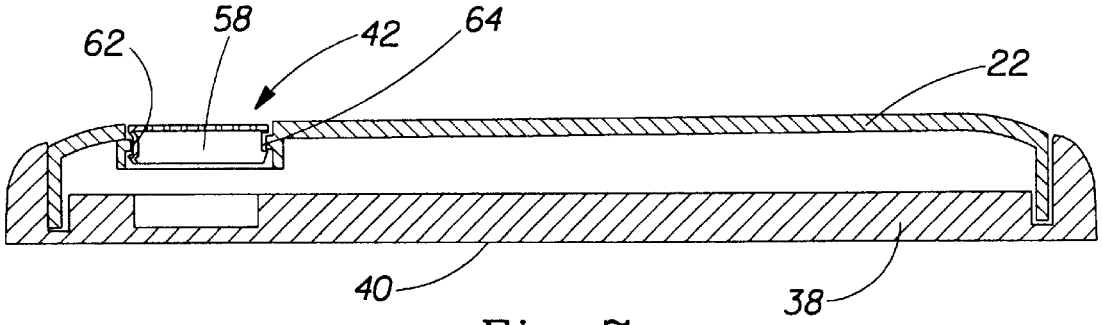
FIG. 7 is a cross-sectional side view of the mop head of FIG. 4 taken along line 6—6 thereof, wherein the universal joint and mop handle have been deleted for clarity.

In accordance with one aspect of the present invention, the mop head 22 also comprises a plurality of attachment structures 42. The attachment structures 42 are configured to receive and retain the sheet 28 about the mop head 22, as shown in FIG. 2, during use. The attachment structures 42 are preferably disposed at the corners of the mop head 22, although these locations can be varied depending upon the size and shape of the mop head 22. As best seen in FIGS. 4 and 5, the attachment structures 42 each comprise a base triangle 44 which is defined along two sides thereof by slits 46 which extend through the flexible material which forms the attachment structures 42. The apex 48 of the base triangle 44 formed by the intersection of the slits 46 is preferably disposed adjacent a side of the mop head 22, as shown in FIG. 4, although the apex 48 of the base triangle 44 can be disposed adjacent the longitudinal axis L of the mop head 22, as shown in FIG. 6. The attachment structures 42 also preferably comprise a plurality of pie-shaped sections 50 having apexes 52 which meet at a substantially common point 54. The pie-shaped sections 50 are defined along two sides thereof by slits 56 which extend through the flexible material from which the attachment structures 42 are formed. This arrangement permits the pie-shaped sections 50 to individually deflect relative to each other. The common point 54 is preferably disposed adjacent the slits 46 defining the base triangle 44. The slits 46 and 56 through the flexible material of the attachment structure 42 allow the pie-shaped sections 50 and the base triangle 44 to deflect under finger pressure so that a portion of the sheet 28 can be pushed through the top surface of the attachment structures 42 and into a cavity 58 (FIG. 7) formed within the attachment structures 42. As the sheet 28 is pushed past the top surface of an attachment structure 42, the apexes 52 of the pie-shaped sections 50 and the apex 48 of the base triangle 44 can pierce and engage the sheet 28 such that the sheet is retained about the mop head 22 during use. Preferably there are at least two and, more preferably, between four and ten pie-shaped sections 50 per base triangle 44. Most preferably, there are about six pie-shaped sections 50 per base triangle 44. The length at least one side of each pie-shaped section 50 is preferably at least about one half of the length of the side of its adjacent base triangle. The ends of the slits 46 and 56 which define the base triangle 44 and each of the pie-shaped sections 50 preferably terminate with a substantially circular opening 60. The circular openings 60 can prevent stress cracking, which can be caused by repeated deflections, of the attachment structure's flexible material at the slit terminations of the pie-shaped sections and the base triangle during use. As shown in FIG. 7, the attachment structures 42 are preferably formed from polyethylene by injection molding and can be retained within the mop head 22 by a ridge 62 disposed on the mop head 22 which engages a slot 64 disposed on the attachment structure 42, although other means of attachment can be implemented.

The plurality of pie-shaped sections 50 arranged about a substantially common point 54 assist in retaining the sheet 28 even when the mop 20 is moved in a direction parallel to the longitudinal axis of the mop head 22. In other words, because the pie shaped sections 50 are angled relative to the transverse axis T (FIG. 1) of the mop head, the pie shaped sections 50 are adapted to retain the sheet about the mop head 22 when the mop 20 is moved in virtually any direction. In addition, placement of the individually deflecting pie-shaped sections adjacent to one another so that their apexes 52 meet at a substantially common point 54 provides an attachment structure 42 through which it is easier for a user to insert a sheet, thereby providing better engagement of the sheet 28 with the attachment structure 42 because the sheet 28 is able to more fully engulf or surround the pie-shaped sections 50 and the base triangle 44. Further, a sheet 28 comprising a scrim and/or low basis weight regions as described in previously incorporated U.S. application Ser. Nos. 09/082,349 and 09/082,396 are believed to further enhance the performance of attachment structures 42, because the apexes 52 are able to more easily penetrate and therefore engage and retain the sheet 28 about the mop head 22 during use.

Figure 8:
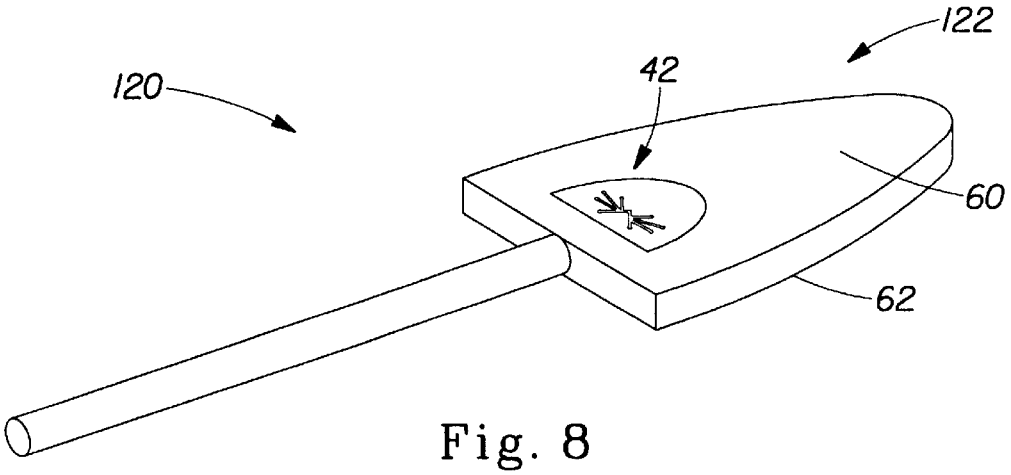
FIG. 8 is a perspective view of a hand duster made in accordance with the present invention.

While the attachment structures of the present invention are preferably used in combination with the floor mop 20, the attachment structures can be used with other cleaning implements as previously discussed. For example, FIG. 8 illustrates a hand duster 120 which is suitable for dusting walls, furniture and the like. The hand duster 120 includes an attachment structure 42 on each of the faces 60 and 62 (the attachment structure 42 is not shown for face 62) of the mop head 122 so that a sheet 28 can be retained about the mop head 122 during use.

The foregoing description of the preferred embodiments of the invention have been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application. It is intended that the scope of the invention be defined by the claims appended hereto.

What is claimed is:

1. A cleaning implement for use with a sheet, comprising:

a handle;

a cleaning head attached to said handle;

at least one attachment structure disposed on said cleaning head for receiving and retaining the sheet about said cleaning head, wherein said attachment structure is formed from a flexible material; and wherein said attachment structure further comprises a base triangle having an apex and a plurality of substantially pie-shaped sections whose apexes meet at a substantially common point adjacent said base triangle and whose apexes are distinct from said base triangle's apex, wherein two sides of each of said base triangle and said pie-shaped sections are defined by slits passing through said flexible material such that each of said base triangle and said pie-shaped sections can be deflected to receive the sheet and wherein each of said slits terminates at one end with a substantially circular opening.

2. The cleaning implement of claim 1, wherein the cleaning implement is provided in the form of a floor mop.

3. The cleaning implement of claim 1, wherein said cleaning head comprises a plurality of said attachment structures.

4. The cleaning implement of claim 3, wherein each of said attachment structures comprises a plurality of said pie shaped sections.

5. The cleaning implement of claim 3, wherein said plurality of pie-shaped sections is between about 4 and about 10 pie-shaped sections.

6. The cleaning implement of claim 1, wherein the apex of said base triangle is disposed adjacent a side of said cleaning head.

7. The cleaning implement of claim 1, wherein the length of one of the sides of said pie-shaped sections is greater than about one-half the length of one of the sides of its adjacent base triangle.

8. A mop for use with a floor, comprising:

a sheet;

a handle;

a mop head pivotally attached to said handle;

a plurality of attachment structures disposed about said mop head for receiving and retaining said sheet, wherein each of said attachment structures is formed from a flexible material; and wherein said attachment structure further comprises a base triangle having an apex and a plurality of substantially pie-shaped sections whose apexes meet at a substantially common point adjacent said base triangle and whose apexes are distinct from said base triangle's apex, wherein two sides of each of said base triangle and said pie-shaped sections are defined by slits passing through said flexible material such that each of said base triangle and said pie-shaped sections can be deflected to receive the sheet and wherein each of said slits terminates at one end with a substantially circular opening.

9. The cleaning implement of claim 8, wherein the apex of said base triangle is disposed adjacent the side of said mop head.

10. The cleaning implement of claim 8, wherein the length of one of the sides of said pie-shaped section is greater than about one-half the length of one of the sides of its adjacent base triangle.

* * * * *